United States Patent [19]

Feldman

[11] 4,044,863

[45] Aug. 30, 1977

[54] CABLE BRAKE AND LOCK

[75] Inventor: Harold P. Feldman, Frederick, Md.

[73] Assignee: The United States of America as represented by the Secretary of the Navy, Washington, D.C.

[21] Appl. No.: 689,894

[22] Filed: May 25, 1976

[51] Int. Cl.[2] ..... B65H 59/10

[52] U.S. Cl. ..... 188/65.1; 102/14; 188/170

[58] Field of Search ..... 188/65.1, 67, 170; 114/206 R; 9/8 R, 9; 102/13, 14

[56] References Cited

U.S. PATENT DOCUMENTS

| | | | |
|---|---|---|---|
| 1,449,168 | 3/1923 | Elia | 102/13 |
| 2,352,226 | 6/1944 | Ronning | 102/14 X |
| 2,909,119 | 10/1959 | Crist | 102/14 |
| 2,972,263 | 2/1961 | Hines | 188/67 |
| 3,851,613 | 12/1974 | Armour | 114/230 |

FOREIGN PATENT DOCUMENTS

| | | | |
|---|---|---|---|
| 117,652 | 7/1918 | United Kingdom | 102/14 |

*Primary Examiner*—George E. A. Halvosa
*Attorney, Agent, or Firm*—R. S. Sciascia; A. L. Branning; W. C. Anderson

[57] ABSTRACT

A cable brake and lock device to control the release of a mooring cable comprises a spring-biased piston abutting an elastic brake element, with the cable passing through both. An initial, preselected force is applied by the spring to the piston and the brake element, causing the element to lock onto the cable. When the force of the ambient, hydrostatic pressure exceeds that of the spring, the spring is compressed, releasing the piston from the elastic brake element to permit the cable to run freely. Any decrease in the ambient pressure will permit the piston to again contact the brake element to lock the cable.

14 Claims, 2 Drawing Figures

CABLE BRAKE AND LOCK

BACKGROUND OF THE INVENTION

The present invention relates to cable brakes, and more particularly to a cable brake and lock mechanism ideally adapted to control the deployment of cables in mooring submarine devices.

Numerous devices exist which are used control the deployment, or payout, of mooring lines and cables to moor marine and submarine devices, such as buoys and mines. Examples of such devices in the prior art are described in U.S. Pat. Nos. 2,971,462, 2,997,970, 3,010,416, 3,039,391 and 3,109,370, which employ electronic, magnetic, barometric means, and combinations thereof to gage the length of cable deployed to adjust or stop the payout of the cable storage spool via complex controls. In general, the prior art devices are cumbersome, complex and expensive, and consequently do not adapt readily to numerous, diverse applications.

Less complex cable brakes and cable locks exist, of course, such as those described in the U.S. Patents to Armour, U.S. Pat. No. 3,851,613, and to Clevett, Jr., U.S. Pat. No. 2,818,622, which utilize the constriction of a cable passage through an elastomeric brake element resulting from a compression of the element, or the wedging action of a tapered brake and lock element to clamp the cable, such as described in the U.S. Pat. No. 3,335,469 to Shand et al and U.S. Pat. No. 2,066,094 to Crawford. These devices, however, are generally manually operated and are not readily applicable to a submarine environment.

A requirement thus exists for a control device to regulate the deployment of a cable in the mooring of submarine apparatuses. Such a device must be automatic in operation and still be simple of construction and compact in size. It must operate reliably in a severe marine environment for prolonged exposure periods, and be capable of maintaining the desired mooring depth within specified limits. The present invention achieves all of these objectives while avoiding the deficiencies of the prior art mechanisms.

SUMMARY OF THE INVENTION

Accordingly, it is an object of the present invention to provide a new and improved cable brake and lock device.

Another object of the present invention is to provide a new and improved cable brake and lock device that is selectively adjustable and automatic in operation.

Still another object of the invention is to provide an adjustable, automatic cable brake and lock device particularly suited to control the mooring of submarine apparatuses.

A further object of the invention is to provided an improved, automatic cable brake and lock device which utilizes ambient hydrostatic pressure to accurately moor a submarine apparatus at a preselected depth.

These and other objects of the invention are attained in a cable brake and lock device having a control spring biasing a piston against a resilient brake element, with the spring force being selectively adjustable. The controlled cable extends through the brake element, and the piston is open to the ambient environment. An initial compression of the spring causes the resilient element to securely lock the cable. After deployment, the system, of which the cable brake and lock device is an integral component, is subjected to hydrostatic pressure. When this pressure on the piston results in a force greater than the preset spring force, the spring is further compressed to relieve the piston force on the brake element and thereby allow free passage of the cable. Any diminishing of the hydrostatic pressure will permit the piston to again cause the brake element to stop and lock the cable. A balance between the spring force and the hydrostatic pressure is achieved and maintained when the system is moored at the desired, preselected depth.

BRIEF DESCRIPTION OF THE DRAWINGS

A more complete understanding of the invention and a fuller appreciation of the many attendant advantages, features and still other objects thereof will be readily derived by reference to the following detailed description when considered in connection with the accompanying drawings, wherein.

DESCRIPTION OF THE PREFERRED EMBODIMENTS

Figure 1:
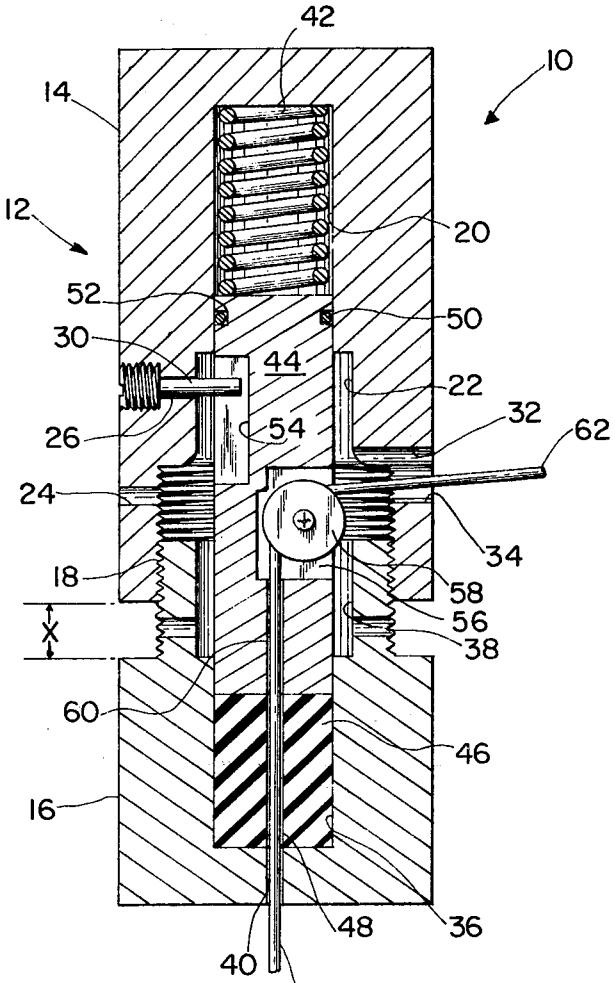
FIG. 1 is a cross-sectional view of one embodiment of the present invention.

Referring now to the drawings wherein like reference characters designate identical or corresponding parts throughout the several views, and more particularly to FIG. 1 thereof, one embodiment of the cable brake and lock device 10 of the present invention is shown in cross section, and includes a housing 12 having two sections 14 and 16 which are joined together at their open ends, as with screw threads 18. The other end of sections 14 and 16 are closed, and the screw threads permit relative adjustment of the sections 14 and 16 along their longitudinal axes.

Section 14 of the housing has a series of three, concentric central bores 20, 22 and 24, with bores 22 and 24 having successively large diameters than bore 20. On a lateral surface of the housing section 14, adjacent to the bore 22, is a radially-extending aperture 26, which may be suitably couterbored and tapped adjacent the surface of section 14 to receive a similarly-shaped guide pin 30 which extends into the bore 22. Circumferentially spaced from the aperture 26 and on the surface of section 14 is a plurality of apertures 32 (one shown) which provide fluid communication between the central bores of the housing section 14 and the outside of the section. Longitudinally adjacent to the fluid communication aperture 32 is a passage 34 extending through the thickness of the section 14, the function of which will be more fully considered hereinbelow. While the communication aperture 32 is shown in FIG. 1 as extending into the bore 22, its longitudnal position can be other than as shown, provided fluid flow is permitted between the environment surrounding the device 10 and the internal volume of the housing 12. Similarly, the longitudinal and circumferential positioning of the guide pin aperture 26, and aperatures 32 and passage 34 can be other than as illustrated in FIG. 1.

Section 16 of the housing 12 is provided with a central bore 36 and a concentric counterbore 38 of large diameter. A longitudinal bore 40 extends axially from the end of the bore 36 to the exterior end surface of the section 16.

Positioned within the bore 20 of the housing section 14 is a spring 42, one end of which presses against the closed end of the bore 20. In abutment against the other end of spring 42 is a piston 44, which extends between the bore 20 in the housing section 14 to the bore 36 in the housing section 16 and reciprocates therein. A brake element 46, having a hole 48 extending through its length along the central longitudinal axis thereof, is positioned within the bore 36, one end being supported by the closed end surface of the bore and the other end in contact with the lower end surface of the piston 44. The brake element 46 is sized to easily fit within the bore 36, with the hole 48 in the brake element in alignment with the longitudinal bore 40 in the closed end of the housing section 16, and may be fabricated of any suitable elastomeric material, such as natural rubber, neoprene or other synthetic rubber.

The ends of the piston 44 are sized to reciprocate within the bores 20 and 36 of housing sections 14 and 16, respectively, but a fluid-tight fit is not provided. As a practical matter, bores 20 and 36 would be identical in diameter, and the piston 44 would be uniform in size and be of a fitting diameter. Approximate the end of the piston 44 which extends into the bore 20 is an annular seal 50 positioned within a receiving annular groove 52 to prevent fluid entry into the spring bore 20. An elongated, longitudinal guide slot 54 extends along that surface of the piston adjacent to the guide pin 30 when the device 10 of the present invention is in the assembled condition shown in FIG. 1. The interior end of the guide pin 30 extends into the slot 54 and cooperates therewith to prevent rotation of the piston 44 relative to the housing 12 while permitting longitudinal motion of the piston within the limits defined by the length of the slot 54.

At approximately midlength, the piston 44 is provided with a recess 56 within which is rotatably supported a cable guide means 58, such as a pulley. A central passageway 60 extends downwardly (relative to FIG. 1) from the recess 56 and aligns with the hole 48 in the brake element 46 and the longitudinal bore 40 in the housing section 16. A cable 62, or some other suitable, flexible connecting means, extends into the bore 24 through the cable passage 34, passes over the guide pulley 58, and through the piston passageway 60, hole 48 and longitudinal bore 40 to pass through the housing section 16.

The free length of the spring 42, as well as the spring constant, the contact area of the piston, the size and type of material of the brake element 46, cable material and diameter, bore diameters, hole sizes and other variable parameters are appropriately selected to fulfill requirements. All materials would preferably be corrosion-resistant to withstand the severity of the marine environment.

An initial locking force is applied to the brake element 46, causing it to immovably grip the cable 62, by applying a preselected compression on the spring 42. This force is applied to the brake element 46 via the piston 44. The preselected spring compression would correspond to the depth below the water surface at which the marine apparatus is to be moored, and more particularly to the hydrostatic pressure at the mooring depth which will equalize the spring pressure on the brake element. The desired spring compression is selected by rotating the housing sections 14 and 16 relative to each other to vary the longitudinal length between the closed end of bore 20 and the closed end of bore 36. The screw threads 18 by which the open ends of the housing sections are joined readily permit of this relative rotation.

For each selected cable brake and lock design there would be calibration data to permit selection of the desired spring compression. As an example, graduated indices can be provided on the surface of the device 10 which would indicate the mooring depth. For instances, the variable distance "X" between the end of the housing section 14 and the end of the threaded section of housing section 16 can be graduated and marked to correlate with the spring compression and, hence, the mooring depth. A smaller value of X would mean a greater spring compression and a higher cable gripping force exerted by the brake element, which would translate into a deeper mooring depth. Of course, the converse would be a more shallow mooring depth.

In operation, the cable brade and lock device 10 is securely attached to the marine apparatus which is to be moored, such as a mine or a subsurface buoy, with the lower portion of the device exposed for fluid communication. More specifically, the fluid communication passages 32 would be exposed for water flow into the inner bores of the device. The mooring cable 62, with one end attached to the marine apparatus (not shown) and the other end secured to a suitable mooring or anchoring mechanism (not shown), is stored within the marine apparatus. The apparatus, the device 10 and the anchoring mechanism would be joined together at the beginning of the deployment sequence, and would sink as a unit. The momentum of the sinking unit will generally carry it below the desired mooring depth, at which time the hydrostatic pressure sensed by the cable lock and brake device will exceed that of the spring pressure. Water entering the inner bores 22, 24 and 38 subjects the piston to the ambient hydrostatic pressure. The fluid seal 50 prevents water entry into the spring bore 20, but since the fit between the piston 44 and the bore 36 in the housing section 16 is not fluid tight, hydrostatic pressure is exerted on the circumferential surface of the piston which is received within the bore 36 and the end surface of the piston contacting the brake element 46. Clearly, the hydrostatic presure acting on the lateral surfaces of the piston produces no net force; but a net force results in the longitudinal direction, which counteracts the spring force to compress the spring and relieve the gripping force on the cable 62 exerted by the brake element 46, thus permitting the cable to pass freely through the housing 12 over the guide pulley 58. At the same time, the anchoring mechanism is permitted to drop below the marine apparatus while the total unit, still joined by the cable, gradually rises due to the buoyancy of the marine apparatus.

As the unit continues to rise, and the anchoring mechanism continues to fall, the ambient hydrostatic pressure decreases to a level at which the spring force exceeds the hydrostatic force, causing the brake element to again lock onto the cable. The momentum of the falling anchoring mechanism pulls the combined unit downwardly, until the hydrostatic pressure again exceeds the spring pressure on the braking element to release the cable, as described hereinabove. This rising and falling oscillating sequence of the unit continues briefly until the marine apparatus stabilizes at the desired mooring depth, and the ambient hydrostatic pressure and the spring pressure are in substantial equilibrium, with the cable securely locked to moor the marine apparatus.

Generally, the marine apparatus will be moored at a depth slightly less than that indicated by the calibration markings since the spring pressure must be somewhat greater than the ambient hydrostatic pressure to permit the brake element to lock the mooring cable. Tests have indicated good accuracy tolerances, within 5% of the desired mooring depth.

Figure 2:
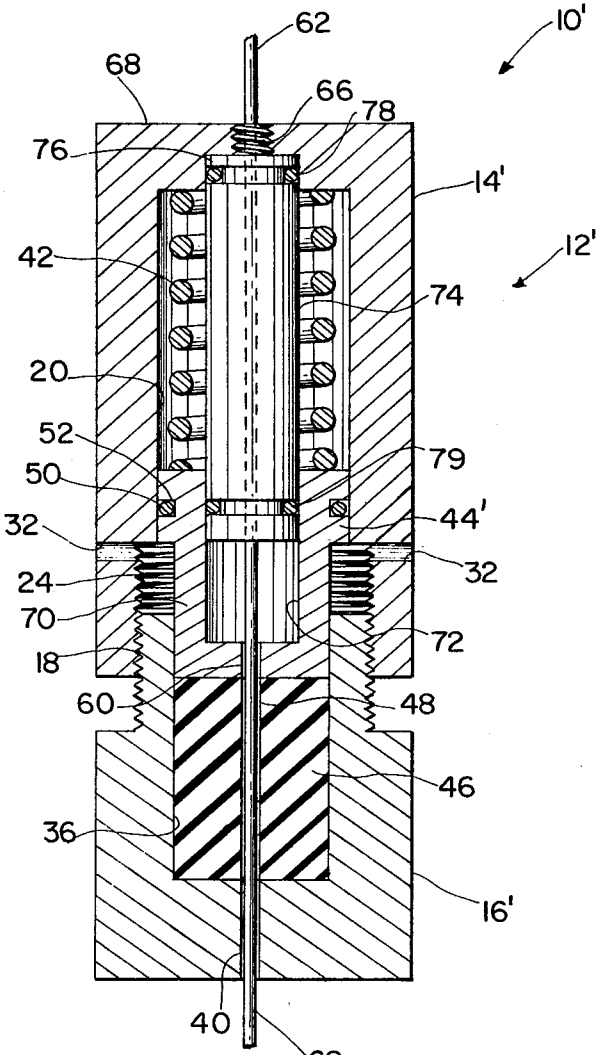
FIG. 2 shows a cross-sectional view of an alternate embodiment.

The embodiment of the cable brake and lock device 10' illustrated in FIG. 2 is substantially similar to the device 10 of FIG. 1, with some modifications to the internal structure to remove the cable guide pulley and eliminate the bending of the cable. The device housing 12' includes sections 14' and 16' joined at their respective open ends by screw threads 18. Housing section 14' has a central, spring receiving bore 20, which opens into the bore 24 adjacent the open end thereof, with the bore 24 receptive of the threaded, open end of the housing section 16' and entry of water via fluid apertures 32 in the sidewall of section 14'. Extending through the closed end of section 14' and into one end of the bore 20, opposite from the end containing the bore 24, is a dual-diameter, stepped axial passage 66, with the smaller-diameter portion extending into the end surface 68 of the housing section 14'.

As shown in FIG. 2, a spring 42 is positioned within the bore 20, one end of the spring pressing against the closed end of the bore 20 and the other end pressing against the enlarged head portion of a piston 44' which is slidably received within the bore 20. Piston 44' is provided with a lower portion 70 of a smaller diameter which extends through the bore 24 and into the central bore 36 of the lower housing section 16'. A central recess 72 extends substantially the length of the piston 44', and the enlarged head portion of the piston is provided with a fluid seal 50 positioned within an annular groove 52 to prevent entry of water into the spring bore 20. The lower surface of the enlarged head portion of the piston 44' is exposed to the bore 24 to provide additional area on which hydrostatic pressure prevails.

A tubular sleeve 74 is positioned within the bore 20 and is encircled by the spring 42. One end of the sleeve 74 is of a reduced diameter and is threaded on its exterior surface for securing engagement with the similarly-threaded portion of the axial passage 66. An annular recess 76 is provided adjacent the threaded segment of the sleeve to receive a seal 78 to prevent water entry into the bore 20. The other end of the sleeve 74 extends into the central recess 72 in the piston 70 and is also provided with a seal 79 to prevent water entry into the spring-receiving bore 20. The tubular sleeve provides an unobstructed passage of the mooring cable 62 through the cable brake and lock device 10', and the piston is freely reciprocal thereon in response to the forces of the spring and the hydrostatic pressure.

The lower housing section 16' is provided with a central bore 36 to receive the lower end portion of the piston 44' and the resilient brake element 46. As in the embodiment of FIG. 1, the end portion of the piston 44' in abutment with the brake element is provided with an aperture 60 in alignment with the hole 48 in the element 46 and the longitudinal bore 40 in the closed end portion of the housing section 16'. Thus, the cable 62 extends through the device 10' via the tubular sleeve 74 and the passage provided by the aligned holes mentioned immediately above.

The controlling operative principles and mode of operation for the embodiment of FIG. 2 are identical to those described for FIG. 1. The spring force, hence the brake clamping force and the mooring depth, is selected by relative adjustment between the housing sections 14' and 16'. Water enters the bore 24 via the fluid aperture 32, and ambient hydrostatic pressure is exerted on all of the piston's exposed surface, including the lower surface of the enlarged head portion, to counteract the spring pressure. Water also enters the tubular sleeve 74 and into the piston recess 72, but is prevented from entry into the spring-receiving bore 20 by the seals 78 and 79.

Obviously, numerous modifications and variations of the present invention are possible in the light of the above teachings. It is therefore to be understood that within the scope of the appended claims the invention may be practiced otherwise than as specifically described herein.

What is claimed as new and desired to be secured by Letters Patent of the United States is:

1. A control device to automatically regulate the deployment of a flexible connecting element passing through the device in response to ambient pressure which comprises:

a housing having a central, longitudinal bore in a fluid communication with the ambient environment;

a resilient element positioned within said bore and having a passage for the flexible connecting element;

a biasing means for applying a selectable, predetermined force to said resilient element and responsive to pressure increase in said bore to reduce the force on said resilient element;

means to vary the force of said biasing means;

said biasing means comprising a force transmitting member reciprocally positioned within said bore having one end in abutting contact with said resilient element;

a spring in said central bore and in biasing contact with the remaining end of said force transmitting member; and wherein two interconnected tubular elements comprise said housing and said means to vary the force of said biasing means includes rotatable connecting means joining said tubular elements, whereby said biasing means responds to increases in the ambient pressure force within said bore to permit the flexible connecting element to pass through said resilient element when the ambient pressure force equals to exceeds the predetermined force of the biasing means and rotation of the tubular elements varies the compression of said spring.

2. The control device of claim 1 further including an aperture in one of said tubular housing members to provide fluid communication between said central bore and the ambient environment.

3. The control device of claim 2 wherein said force transmitting member is provided with a longitudinal bore for the passage of the flexible connecting element.

4. The control device of claim 3 wherein said resilient element comprises an elastomeric material deformable under pressure to exert a gripping force on the flexible connecting element.

5. The control device of claim 3 further including a guide member rotatably supported on said force transmitting member to guide the passage of the flexible connecting element through the control device.

6. The control device of claim 5 further including a guide pin cooperating with said force transmitting member to prevent rotational motion of said force transmitting member.

7. The control device of claim 3 further including:

a tubular sleeve within said central bore and circumscribed by said spring; and a central bore in said force transmitting member to reciprocally receive one end portion of said tubular sleeve, the flexible connecting element passing through said tubular sleeve, the bore of said force transmitting member and said resilient element.

8. The control device of claim 7 wherein the end portions of said tubular sleeve are provided with fluid seals to prevent fluid entry into the region of said central bore surrounding said spring.

9. The control device of claim 8 wherein the end portion of said force transmitting member distal from said resilient element is provided with a fluid seal to prevent fluid entry into the region of said bore surrounding said spring.

10. In combination with a mooring cable, a cable brake and lock device to automatically control the passage of the mooring cable through the device in response to ambient hydrostatic pressure to control the deployed mooring length of the cable which comprises:

a segmented tubular housing having a longitudinal chamber in fluid communication with the ambient water;

an elastomeric brake element within said chamber proximate one closed end portion of said housing, said brake element having a central hole for passage of the mooring cable;

a resilient spring within said chamber proximate the other closed end portion of said housing;

a piston member reciprocally positioned within said chamber and in abutting contact with said spring and said brake element, said piston member movable in response to spring force to cause said brake element to grip the mooring cable passing through said brake element and in response to increased hydrostatic pressure within said chamber to remove the gripping force of the brake element on the mooring cable;

adjustment means to selectively vary the force of said resilient spring; and wherein said adjustment means comprises threaded attachment means to rotatably join the open end portions of said segmented tubular housing, said attachment means permitting adjustment of the total length of said longitudinal chamber to vary the spring force.

11. The combination of claim 10 further including a cable guide means rotatably supported on said piston member to guide the passage of the mooring cable through the device.

12. The combination of claim 10 futher including a tubular sleeve within said chamber and circumscribed by said resilient spring, the mooring cable passing longitudinally through said sleeve.

13. The combination of claim 12 wherein the portion of said piston member adjacent said resilient spring is provided with a central recess to reciprocally receive said tubular sleeve.

14. The combination of claim 13 further including:

fluid seal means on the end portions of said tubular sleeve; and a sealing ring adjacent the end portion of said piston member distal from said brake element, said seal means and said sealing ring preventing entry of water into the region of said chamber surrounding said resilient spring.

* * * * *